US009721582B1

(12) United States Patent
Huang et al.

(10) Patent No.: US 9,721,582 B1
(45) Date of Patent: Aug. 1, 2017

(54) GLOBALLY OPTIMIZED LEAST-SQUARES POST-FILTERING FOR SPEECH ENHANCEMENT

(71) Applicant: Google Inc., Mountain View, CA (US)

(72) Inventors: Yiteng Huang, Bridgewater, NJ (US); Alejandro Luebs, San Francisco, CA (US); Jan Skoglund, San Francisco, CA (US); Willem Bastiaan Kleijn, Wellington (NZ)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 15/014,481

(22) Filed: Feb. 3, 2016

(51) Int. Cl.

| | |
|---|---|
| ***H04R 3/00*** | (2006.01) |
| ***G10L 21/0216*** | (2013.01) |
| ***G10L 21/0264*** | (2013.01) |
| ***G10L 21/02*** | (2013.01) |
| ***G10L 25/21*** | (2013.01) |
| ***G10L 21/0308*** | (2013.01) |

(52) U.S. Cl.
CPC ..... *G10L 21/0216* (2013.01); *G10L 21/0205* (2013.01); *G10L 21/0264* (2013.01); *G10L 21/0308* (2013.01); *G10L 25/21* (2013.01); *H04R 3/005* (2013.01); *G10L 2021/02166* (2013.01)

(58) Field of Classification Search
CPC ..... G10L 21/0264; G10L 2021/02166; H04R 3/005
USPC ..... 704/233; 381/94.1, 92
See application file for complete search history.

(56) References Cited

U.S. PATENT DOCUMENTS 5,729,613 A * 3/1998 Poletti ..... G10K 15/12 381/63
8,392,184 B2 3/2013 Buck et al.
(Continued)

FOREIGN PATENT DOCUMENTS

| | | |
|---|---|---|
| EP | 2 026 597 B1 | 11/2009 |
| EP | 2 081 189 B1 | 9/2010 |
| EP | 2738762 A1 | 6/2014 |

OTHER PUBLICATIONS

I.A. McCowan and H. Bourlard, "Microphone Array Post-Filter Based on Noise Field Coherence," IEEE Trans. Speech Audio Proc., vol. 11, pp. 709-716, Nov. 2003.
(Continued)

*Primary Examiner* — Shaun Roberts
(74) *Attorney, Agent, or Firm* — Young Basile Hanlon & MacFarlane, P.C.

(57) ABSTRACT

Existing post-filtering methods for microphone array speech enhancement have two common deficiencies. First, they assume that noise is either white or diffuse and cannot deal with point interferers. Second, they estimate the post-filter coefficients using only two microphones at a time, performing averaging over all the microphones pairs, yielding a suboptimal solution. The provided method describes a post-filtering solution that implements signal models which handle white noise, diffuse noise, and point interferers. The method also implements a globally optimized least-squares approach of microphones in a microphone array, providing a more optimal solution than existing conventional methods. Experimental results demonstrate the described method outperforming conventional methods in various acoustic scenarios.

17 Claims, 7 Drawing Sheets

(56) References Cited

U.S. PATENT DOCUMENTS

| | | | | |
|---|---|---|---|---|
| 2004/0001598 | A1* | 1/2004 | Balan | G06K 9/0057 381/92 |
| 2004/0220800 | A1* | 11/2004 | Kong | G10L 21/0208 704/205 |
| 2010/0217590 | A1* | 8/2010 | Nemer | G01S 3/8006 704/233 |
| 2011/0305345 | A1* | 12/2011 | Bouchard | G10L 21/0208 381/23.1 |
| 2014/0056435 | A1* | 2/2014 | Kjems | H04M 9/082 381/66 |

OTHER PUBLICATIONS

Rainer Zelinski, "A Microphone Array with Adaptive Post-Filtering for Noise Reduction in Reverberant Rooms," in Proc. IEEE ICASSP, Apr. 1988, vol. 5, pp. 2578-2581.

S. Leukimmiatis and P. Maragos, "Optimum Post-Filter Estimation for Noise Reduction in Multichannel Speech Processing," in Proc. EUSIPCO, Sep. 2006, pp. 1-5.

Pan et al., "On the Noise Reduction Performance of the MVDR Beamformer in Noisy and Reverberant Environments", 2014 IEEE International Conference on Acoustic, Speech and Signal Processing (ICASSP), May 4, 2014, pp. 815-819.

Peled et al., "Linearly Constrained Minimum Variance Method for Spherical Microphone Arrays in a Coherent Environment", IEEE 2011 Joint Workshop on Hands-Free Speech Communication and Microphone Arrays (HSCMA), May 30, 2011, pp. 86-91.

International Search Report in corresponding PCT/US2017/016187, dated Apr. 26, 2017, 5 pp.

* cited by examiner

GLOBALLY OPTIMIZED LEAST-SQUARES POST-FILTERING FOR SPEECH ENHANCEMENT

BACKGROUND

Microphone arrays are increasingly being recognized as an effective tool to combat noise, interference, and reverberation for speech acquisition in adverse acoustic environments. Applications include robust speech recognition, hands-free voice communication and teleconferencing, hearing aids, to name just a few. Beamforming is a traditional microphone array processing technique that provides a form of spatial filtering: receiving signals coming from specific directions while attenuating signals from other directions. While spatial filtering is possible, it is not optimal in the minimum mean square error (MMSE) sense from a signal reconstruction perspective.

One conventional method for post-filtering is the multichannel Wiener filter (MCWF), which can be decomposed into a minimum variance distortionless response (MVDR) beamformer and a single-channel post-filter. Currently known conventional post-filtering methods are capable of improving speech quality after beamforming; however, such existing methods have two common limitations or deficiencies. First, these methods assume the relevant noise is only either white (incoherent) noise or diffuse noise, thus the methods do not address point interferers. Point interferers are, for example, in an environment with multiple persons speaking and where one person is a desired audio source, the unwanted noise coming from other speakers. Second, these existing approaches apply a heuristic technique where post-filter coefficients are estimated using two microphones at a time and then averaged over all microphone pairs, which leads to sub-optimal results.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

In general, one aspect of the subject matter described in this specification can be embodied in methods, apparatuses, and computer-readable medium. An example apparatus includes one or more processing devices and one or more storage devices storing instructions that, when executed by the one or more processing devices, cause the one or more processing devices to implement an example method. An example computer-readable medium includes sets of instructions to implement an example method. One embodiment of the present disclosure relates to a method for estimating coefficient values to reduce noise for a post-filter, the method comprising: receiving audio signals via a microphone array from sound sources in an environment; hypothesizing a sound field scenario based on the received audio signals; calculating fixed beamformer coefficients based on the received audio signals; determining covariance matrix models based on the hypothesized sound field scenario; calculating a covariance matrix based on the received audio signals; estimating power of the sound sources to find solution that minimizes the difference between the determined covariance matrix models and the calculated covariance matrix; calculating and applying post-filter coefficients based on the estimated power; and generating an output audio signal based on the received audio signals and the post-filter coefficients.

In one or more embodiments, the methods described herein may optionally include one or more of the following additional features: hypothesizing multiple sound field scenarios to generate multiple output signals, wherein the multiple generated output signals are compared and the output signal with the highest signal-to-noise ratio among the multiple output generated signals; estimating the power based on the Frobenius norm, wherein the Frobenius norm is computed using the Hermitian symmetry of the covariance matrices; determining the location of at least one of the sound sources using sound-source location methods to hypothesize the sound field scenario, determining the covariance matrix models, and calculating the covariance matrix; and generating the covariance matrix models based on a plurality of hypothesized sound field scenarios, wherein a covariance matrix model is selected to maximize an objective function that reduces noise, and wherein an objective function is the sample variance of the final output audio signal.

Further scope of applicability of the present disclosure will become apparent from the Detailed Description given below. However, it should be understood that the Detailed Description, while describing preferred embodiments, is given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

The headings provided herein are for convenience only and do not necessarily affect the scope or meaning of the claims.

DETAILED DESCRIPTION

The present disclosure generally relates to systems and methods for audio signal processing. More specifically, aspects of the present disclosure relate to post-filtering techniques for microphone array speech enhancement.

The following description provides specific details for a thorough understanding and enabling description of the disclosure. One skilled in the relevant art will understand, however, that the embodiments described herein may be practiced without many of these details. Likewise, one skilled in the relevant art will also understand that the example embodiments described herein can include many other obvious features not described in detail herein. Additionally, some well-known structures or functions may not be shown or described in detail below, so as to avoid unnecessarily obscuring the relevant description.

1. Introduction

Certain embodiments and features of the present disclosure relate to methods and systems for post-filtering audio signals that utilizes a signal model that accounts for not only diffuse and white noise, but also point interfering sources. As will be described in greater detail below, the methods and systems are designed to achieve a globally optimized least-squares (LS) solution of microphones in a microphone array. In certain implementations, the performance of the disclosed method is evaluated using real recorded impulse responses for the desired and interfering sources, including synthesized diffuse and white noise. The impulse response is the output or reaction of a dynamic system to a brief input signal called an impulse.

Figure 1:
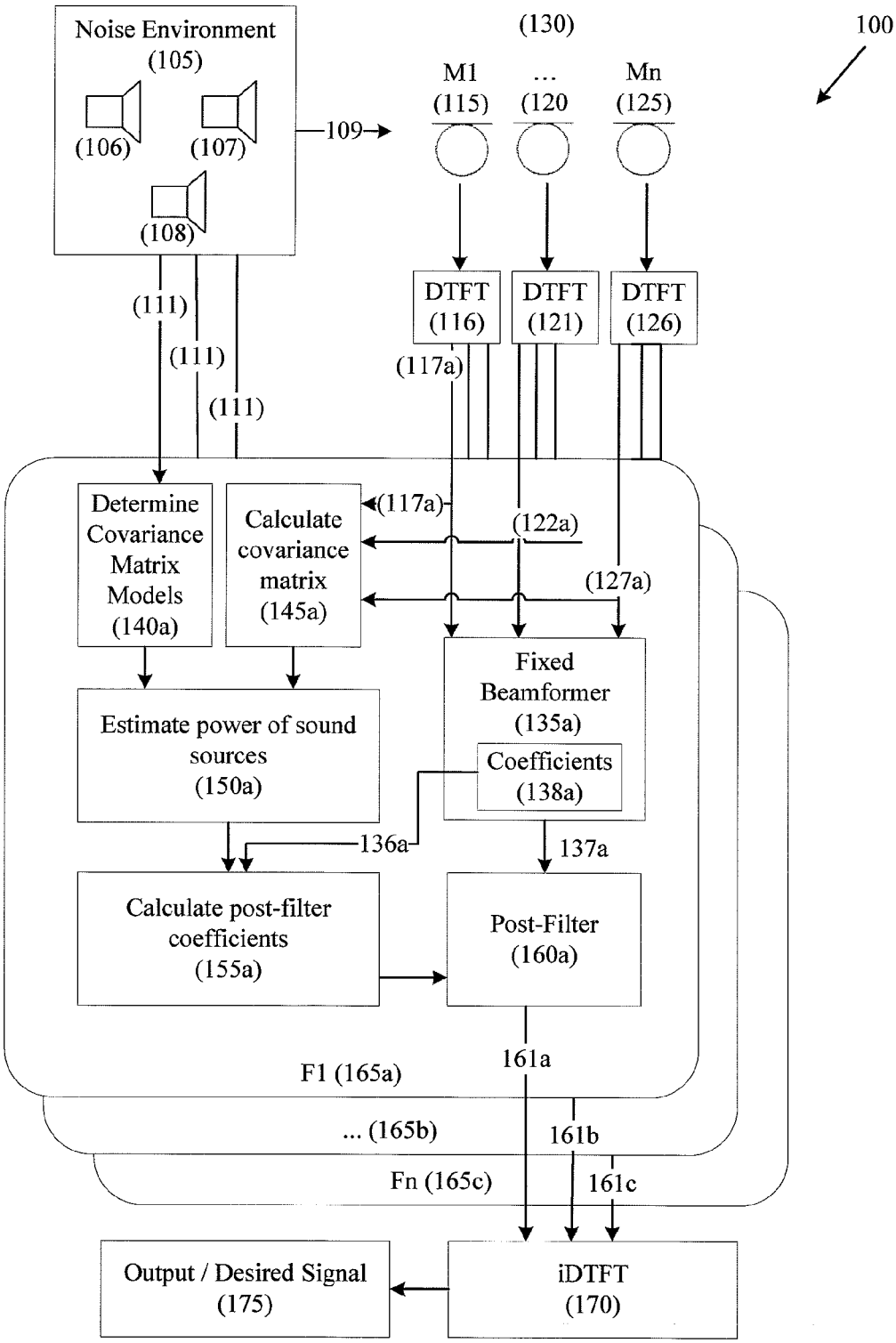
FIG. 1 is a functional block diagram illustrating an example system for generating a post-filtered output signal based on a hypothesized sound field scenario in accordance with one or more embodiments described herein.

FIG. 1 illustrates an example system for generating a post-filtered output signal (175) based on a hypothesized sound field scenario (111). A hypothesized sound field scenario (111) is a determination of the makeup of the noise components (106-108) in a noise environment (105). In this example embodiment, one hypothesized sound field scenario (111) is inputted into the various frequency bins F1 to Fn (165*a-c*) to generate an output/desired signal (175). For a hypothesized sound field scenario (111), signals are transformed to a frequency domain. Beamforming and post-filtering are carried out independently from frequency to frequency.

In this example embodiment, a hypothesized sound field scenario includes one interfering source. In other example embodiments, hypothesized sound field scenarios may be more complex, including numerous interfering scenarios.

Also, in other example embodiments, multiple hypothesized sound field scenarios may be determined to generate multiple output signals. One skilled in the relevant art will understand that multiple sound field scenarios may be hypothesized based on various factors, such as information that may be known or determined about the environment. One skilled in the art will also understand that the quality of the output signals may be determined using various factors, such as measuring the signal-to-noise ratio (as measured, for example, in the experiments discussed below). In other example embodiments, a person skilled in the art may apply other methods to hypothesize sound field scenarios and determine the quality of the output signals.

FIG. 1 illustrates a noise environment (105) which may include one or more noise components (106-108). The noise components (106-108) in an environment (105) may include, for example, diffuse noise, white noise, and/or point interfering noise sources. The noise components (106-108) or noise sources in an environment (105) may be positioned in various locations, projecting noise in various directions, and at various power/strength levels. Each noise component (106-108) generates audio signals that may be received by a plurality of microphones M1 . . . Mn (115, 120, 125) in a microphone array (130). The audio signals that are generated by the noise components (106-108) in an environment (105) and received by each of the microphones (115, 120, 125) in a microphone array (130) are depicted as 109, a single arrow, in the example illustration for clarity.

The microphone array (130) includes a plurality of individual omnidirectional microphones (115, 120, 125). This embodiment assumes omnidirectional microphones. Other example embodiments may implement other types of microphones which may alter the covariance matrix models. The audio signals (109) received by each of the microphones M1 to Mn (where "n" is an arbitrary integer) (115, 120, 125) may be converted to the frequency domain via a transformation method, such as, for example, Discrete-time Fourier Transformation (DTFT) (116, 121, 126). Other example transformation methods may include, but are not limited to, FFT (Fast Fourier Transformation), or STFT (Short-time Fourier Transformation). For simplicity, the output signals generated via each of the DTFT's (116, 121, 126) corresponding to one frequency are represented by a single arrow. For example, the DTFT audio signal at the first frequency bin, F1 (165*a*), generated by audio received by microphone M1 (115) is represented as a single arrow 117*a*.

FIG. 1 also illustrates multiple frequency bins (165*a-c*), which contain various components, and where each frequency bin's post-filter component generates a post-filter output signal. For instance, frequency bin F1's (165*a*) post-filter component (160*a*) generates a post-filter output signal of the first frequency bin (161*a*). The output signals for each frequency bin (165*a-c*) are inputted into an inverse DTFT component (170) to generate the final time-domain output/desired signal (175) with reduced unwanted noise. The details and steps of the various components in the frequency bins (165*a-c*) in this example system (100) are described in further detail below.

2. Signal Models

Figure 2:
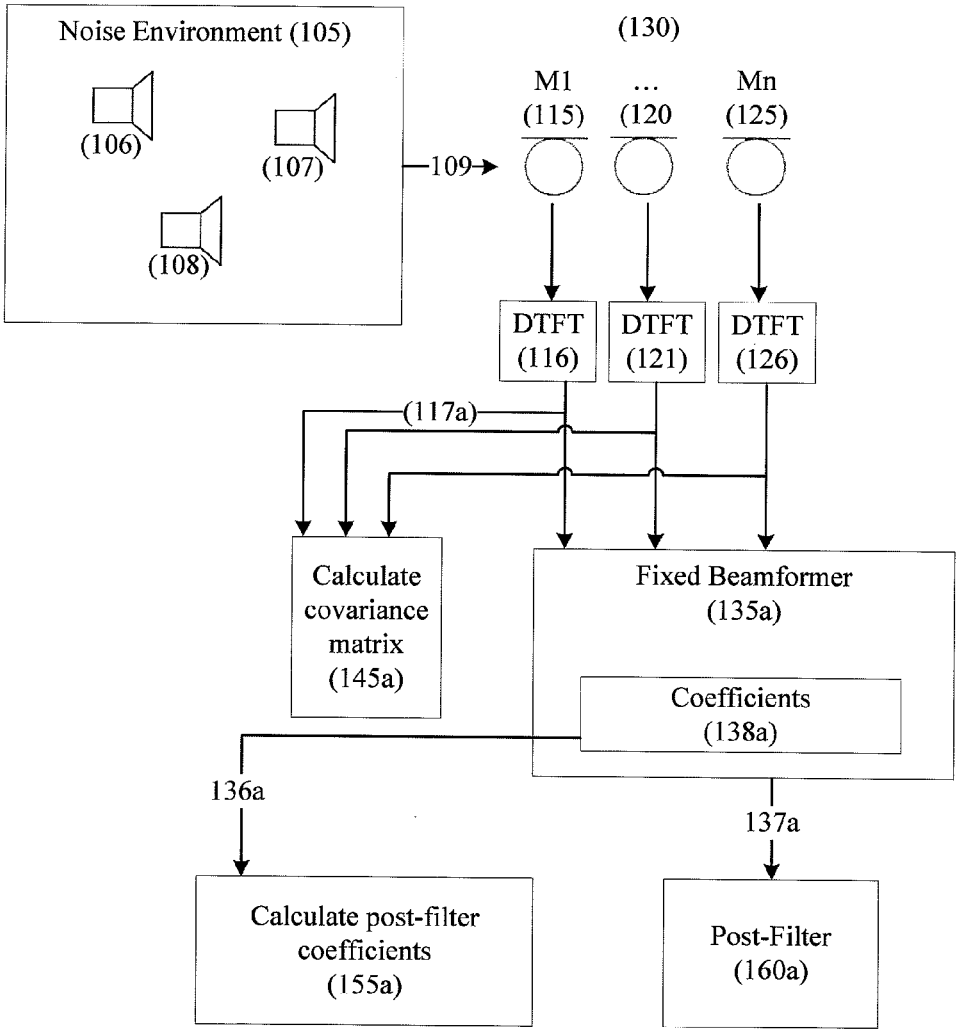
FIG. 2 is a functional block diagram illustrating a beamformed single-channel output generated from a noise environment in an example system.

FIG. 2 illustrates a beamformed single-channel output (136*a*) generated from a noise environment (105). Components from the overall system 100 (as depicted in FIG. 1) not discussed here, have been omitted from FIG. 2 for simplicity. A noise environment (105) contains various noise components (106-108) that generate output as sound. In this example embodiment, noise component 106 outputs desired sound, and noise components 107 and 108 output undesired sound, which may be in the form of white noise, diffuse noise, or point interfering noise. Each of the noise components (106-108) generates sound; however, for simplicity, the combined output of the noise components (106-108) is depicted as a single arrow 109. The microphones (115, 120, 125) in the array (130) receive the environment noise (109) at various time intervals based on the microphone's physical locations and the directions and strength of the incoming audio signals within the environment noise (109). The received audio signals at each of the microphones (115, 120, 125) is transformed (116, 121, 126) and beamformed (135*a*) to generate a single-channel output (137*a*) for one single frequency. The fixed beamformer's (135*a*) single channel-output (137*a*) is passed to the post-filter (160*a*). The beamforming coefficients (138*a*), represented as $h(j\omega)$, associated with Equation (6) below, are generating the beamforming filters (136*a*) are passed to calculate post-filter coefficients (155*a*).

A more detailed description of capturing the environment noise (109) and generating the beamformed single-channel output signal (137*a*) and the beamforming filters (136*a*) are described here. Suppose a microphone array (130) of M elements (115, 120, 125), where M, an arbitrary integer value, is the number of microphones in the array (130), to capture the signal s(t) from a desired point sound source (106) in a noisy acoustic environment (105). The output of the mth microphone in the time domain is written as $$x_m(t)=g_{s,m}*s(t)+\psi_m(t), m=1,2, \ldots ,M, \tag{1}$$

where $g_{s,m}$ denotes the impulse response from the desired component (106) to the mth microphone (e.g. 125), * denotes linear convolution, and $\psi_m(t)$ is the unwanted additive noise (i.e., sound generated by noise components 107 and 108).

The disclosed method is capable of dealing with multiple point interfering sources; however, for clarity, one point interferer is described in the examples provided herein. The additive noise commonly consists of three different types of sound components: 1) coherent noise from a point interfering source, v(t), 2) diffuse noise, $u_m(t)$, and 3) white noise, $w_m(t)$. Also, $$\psi_m(t)\triangleq g_{v,m}*v(t)+u_m(t)+w_m(t), \tag{2}$$

where $g_{v,m}$ is the impulse response from the point noise source to the mth microphone. In this example embodiment, the desired signal and these noise components (106-108) are presumed short-time stationary and mutually uncorrelated. In other example embodiments, the noise components may be comprised differently. For example, a noise environment which contains multiple desired sound sources moving around and the target desired sound source may alternate over a time period. In other words, a crowded room where two people are walking while having a conversation.

In the frequency domain, this generalized microphone array signal model in Equation (1) is transformed into $$\begin{aligned} X_m(j\omega) &= G_{s,m}(j\omega)S(j\omega)+\Psi(j\omega) \\ &= G_{s,m}(j\omega)S(j\omega)+G_{v,m}(j\omega)V(j\omega)+ \\ &\quad U(j\omega)+W(j\omega), \end{aligned} \tag{3}$$

where $j\triangleq\sqrt{-1}$, ω is the angular frequency, and $X_m(j\omega)$, $G_{s,m}(j\omega)$, $S(j\omega)$, $G_{v,m}(j\omega)$, $V(j\omega)$, $U(j\omega)$, $W(j\omega)$ are the discrete-time Fourier transforms (DTFTs) of $x_m(t)$, $g_{s,m}$, s(t), $g_{v,m}$, v(t), u(t), and w(t), respectively. In the example embodiments, DTFT is implemented; however, it should not be construed to limit the scope of the invention. Other example embodiments may implement other methods such as STFT (Short Time Fourier Transformation) or FFT (Fast Fourier Transformation). Equation (3) in a vector/matrix form is as follows $$x(j\omega)=S(j\omega)g_a(j\omega)+V(j\omega)g_v(j\omega)+u(j\omega)+w(j\omega), \tag{4}$$

where $$z(j\omega)\triangleq[Z_1(j\omega)Z_2(j\omega) \ldots Z_M(j\omega)]^T, z\epsilon\{x,u,w\},$$

$$g_z(j\omega)\triangleq[G_{z,1}(j\omega)G_{z,2}(j\omega) \ldots G_{z,M}(j\omega)]^T, z\epsilon\{s,v\},$$

$(\bullet)^T$ denotes the transpose of a vector or a matrix. The microphone array spatial covariance matrix is then determined as $$\begin{aligned} R_{xx}(j\omega)&=\sigma_s^2(\omega)P_{g_s}(j\omega)+R_{\psi\psi}(j\omega)=\sigma_s^2(\omega)P_{g_s}(j\omega)+\sigma_v^2 \\ &\quad(\omega)P_{g_v}(j\omega)+R_{uu}(j\omega)+R_{ww}(j\omega), \end{aligned} \tag{5}$$

where mutually uncorrelated signals are assumed, $$R_{xx}(j\omega)\triangleq E\{z(j\omega)z^H(j\omega)\}, z\epsilon\{x,\psi,u,w\},$$

$$P_{g_z}(j\omega)\triangleq g_z(j\omega)g_z^H(j\omega), z\epsilon\{s,v\},$$

$$\sigma_z^2(\omega)\triangleq E\{Z(j\omega)Z^*(j\omega)\}, z\epsilon\{s,v\},$$

and $E\{\bullet\}$, $(\bullet)^H$, and $(\bullet)^*$ denote the mathematical expectation, the Hermitian transpose of a vector or matrix, and the conjugate of a complex variable, respectively.

A beamformer (135*a*) filters each microphone signal by a finite impulse response (FIR) filter $H_m(j\omega)$ (m=1, 2, . . . , M) and sums the results to produce a single-channel output (137*a*)

$$Y(j\omega)=\sum_{m=1}^{M}H_m^*(j\omega)X_m(j\omega)=h^H(j\omega)x(j\omega), \tag{6}$$

and beamforming filters (136*a*), where $$h(j\omega)\triangleq[H_1(j\omega)\ \ H_2(j\omega)\ \ \ldots\ \ H_M(j\omega)]^T.$$

In Equation (6), the covariance matrix of the desired sound source is also modeled. Its model is similar to that of the interfering source since both the desired and the interfering sources are point sources. They differ in their directions with respect to the microphone array.

3. Modeling Noise Covariance Matrices

Figure 3:
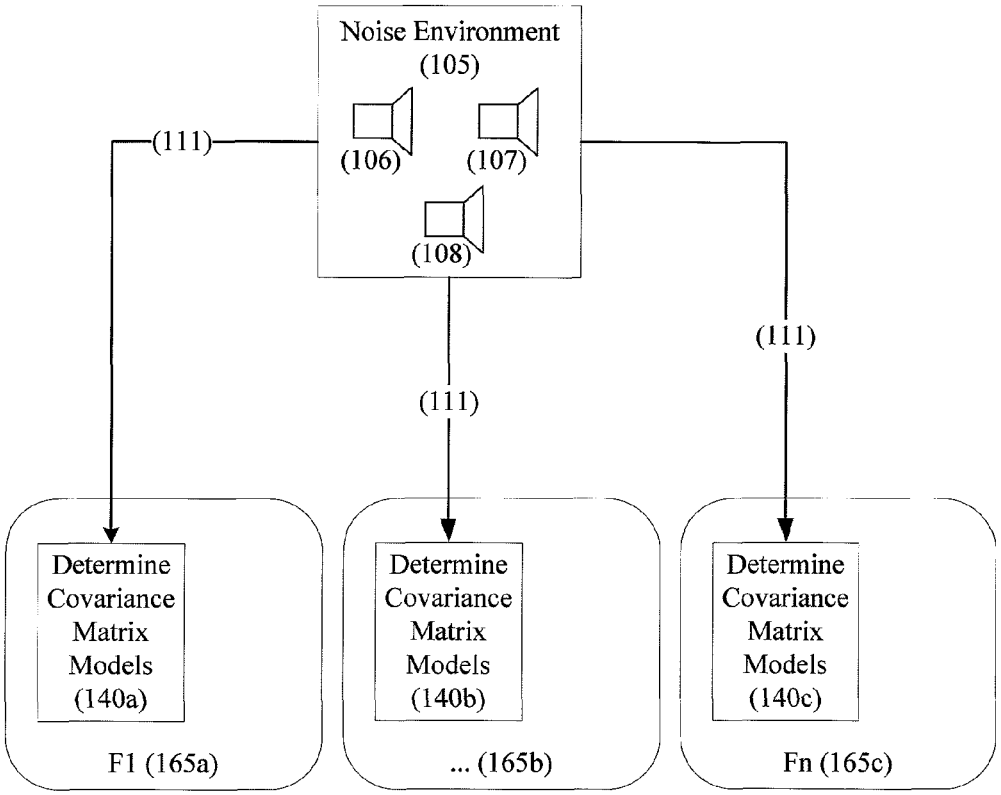
FIG. 3 is a functional block diagram illustrating the determination of covariance matrix models based on a hypothesized sound field scenario in an example system.

FIG. 3 illustrates the steps for determining covariance matrix models based on a hypothesized sound field scenario (111). Components from the overall system 100 (as depicted in FIG. 1) not discussed here, have been omitted from FIG. 3 for simplicity. A hypothesized sound field scenario (111) is determined based on the noise environment (105) and inputted into the covariance models (140*a-c*) for each frequency bin (165*a-c*) respectively.

In an actual environment, the makeup of noise components, i.e. the number and location of point interfering sources and the presence of white or diffuse noise sources may not be known. Thus, a sound field scenario is hypothesized. Equation (2) above represents a scenario with one point interfering source, diffuse noise, and white noise, resulting in four unknowns. If the scenario hypothesizes or assumes no point interfering source, only white and diffuse noise, the above Equation (5) can then be simplified resulting in only three unknowns.

In Equation (5), three interference/noise-related components (106-108) are modeled as follows:

(1) Point Interferer:

The covariance matrix $P_{g^v}(j\omega)$ due to the point interfering source v(t) has rank 1. In general, when reverberation is present or the source is in the near field of the microphone array, the complex elements of the impulse response vector $g_v$ may have different magnitudes. But if only the direct path is taken into account or if the point source is in the far field, then $$g_v(j\omega)=[e^{-j\omega T_{v,1}}e^{-j\omega T_{v,2}} \ldots e^{-j\omega T_{v,M}}]T, \tag{7}$$

which incorporates only the interferer's time differences of arrival at the multiple microphones $\tau_{v,m}$ (m=1, 2, . . . , M) with respect to a common reference point.

(2) Diffuse Noise:

A diffuse noise field is considered spherically or cylindrically isotropic, in that it is characterized by uncorrelated noise signals of equal power propagating in multiple directions simultaneously. Its covariance matrix is given by $$R_{uu}(j\omega)=\sigma_u^2(\omega)\Gamma_{uu}(\omega), \tag{8}$$

where the (p, q)th element of $\Gamma_{uu}(\omega)$ is $$[\Gamma_{uu}(\omega)]_{p,q} = \begin{cases} sinc\left(\frac{\omega \cdot d_{pq}}{c}\right), & \text{Spherically Isotropic} \\ J_0\left(\frac{\omega \cdot d_{pq}}{c}\right), & \text{Cylindrically Isotropic} \end{cases} \quad (9)$$

$d_{pq}$ is the distance between the pth and qth microphones, c is the speed of sound, and $J_0(\bullet)$ is the zero-order Bessel function of the first kind.

(3) White Noise:

The covariance matrix of additive white noise is simply a weighted identity matrix:

$$R_{ww}(j\omega)=\sigma_w^2(\omega)\cdot I_{M\times M}. \quad (10)$$

4. Multichannel Wiener Filter (MCWF), MVDR Beamforming, and Post-Filtering

When a microphone array is used to capture a desired wideband sound signal (e.g., speech and/or music), the intention is to minimize the distance between Y (jω) in Equation (6) and S(jω) for ω's. The MCWF that is optimal in the MMSE sense can be decomposed into a MVDR beamformer followed by a single-channel Wiener filter (SCWF):

$$h_{MCWF}(j\omega) = \underbrace{\frac{R_{\psi\psi}^{-1}(j\omega)g_s(j\omega)}{g_s^H(j\omega)R_{\psi\psi}^{-1}(j\omega)g_s(j\omega)}}_{\triangleq h_{MVDR}(j\omega)} \cdot \underbrace{\frac{\sigma_{s'}^2(\omega)}{\sigma_{s'}^2(\omega)+\sigma_{\psi'}^2(\omega)}}_{\triangleq h_{SCWF}(\omega)}, \quad (11)$$

where $$\sigma_{s'}^2(\omega) \triangleq \sigma_s^2(\omega)\cdot h_{MVDR}^H(j\omega)P_{g_s}(j\omega)h_{MVDR}(j\omega),$$

$$\sigma_{\psi'}^2(\omega) \triangleq h_{MVDR}^H(j\omega)R_{\psi\psi}(j\omega)h_{MVDR}(j\omega)$$

where are the power of the desired signal and noise at the output of the MVDR beamformer, respectively. This decomposition leads to the following structure for microphone array speech acquisition: the SCWF is regarded as a post-filter after the MVDR beamformer.

5. Post-Filter Estimation

Figure 4:
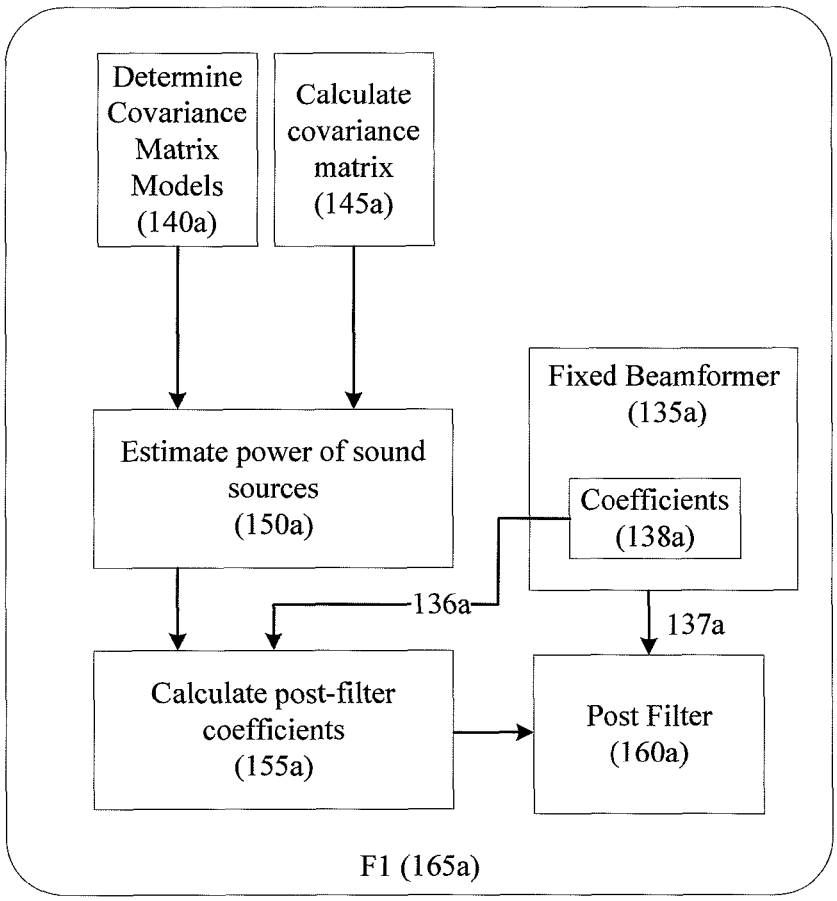
FIG. 4 is a functional block diagram illustrating the post-filter estimation for a frequency bin.

FIG. 4 illustrates the post-filter estimation steps in a frequency bin. In order to implement the front-end MVDR beamformer and the SCWF as a post-processor given in Equation (11), the signal and noise covariance matrices from the calculated covariance matrix of the microphone signals are estimated. The multichannel microphone signals are first windowed (e.g., by a weighted overlap-add analysis window) in frames and then transformed by a FFT to determine x(jω, i), where i is the frame index. The estimate of the microphone signals' covariance matrix (145*a*) is recursively updated, dynamically or using a memory component, by $$\hat{R}_{xx}(j\omega,i)=\lambda\hat{R}_{xx}((j\omega,i-1)+(1-\lambda)x(j\omega,i)x^H(j\omega,i), \quad (12)$$

where $0<\lambda<1$ is a forgetting factor.

Again, similar to Equation (7), reverberation may be ignored, resulting in $$g_s(j\omega)=[e^{-j\omega T_{s,1}}e^{-j\omega T_{s,2}} \ldots e^{-j\omega T_{s,M}}]^T, \quad (13)$$

where $\tau_{s,m}$ is the desired signal's time difference of arrival for the mth microphone with respect to the common reference point.

In another example, suppose that both $\Sigma_{s,m}$ and $\tau_{v,m}$ are known and do not change over time. Thus, according to Equation (5), using Equation (8) and Equation (10), at the ith time frame, the determination of the covariance matrix models (140*a*) may be determined as follows:

$$R_{xx}(j\omega,i)=\sigma_s^2(\omega,i)P_{g_s}(j\omega)+\sigma_v^2(\omega,i)P_{g_v}(j\omega)+\sigma_u^2(\omega,i)\Gamma_{uu}(\omega)+\sigma_w^2(\omega,i)I_{M\times M}. \quad (14)$$

This equality allows defining a criterion based on the Frobenius norm of the difference between the left and the right hand sides of Equation (14). By minimizing such a criterion, an LS estimator for $\{\sigma_s^2(\omega, k), \sigma_v^2(\omega, k), \sigma_u^2(\omega, k), \sigma_w^2(\omega, k)\}$ may be deduced. Note that the matrices in Equation (14) are Hermitian. Redundant information in this formulation has been omitted for clarity.

For an M×M Hermitian matrix $A=[a_{pq}]$, two vectors may be defined. One vector is the diagonal elements and the other is the off-diagonal half vectorization (odhv) of its lower triangular part $$\text{diag}\{A\} \triangleq [a_{11}a_{22} \ldots a_{MM}]^T. \quad (15)$$

$$\text{odhv}\{A\} \triangleq [a_{21} \ldots a_{M1}\ a_{32} \ldots a_{M2} \ldots a_{M(M-1)}]^T. \quad (16)$$

A plurality of N Hermitian matrices of the same size may be defined as $$\text{diag}\{A_1, \ldots, A_N\} \triangleq [\text{diag}\{A_1\} \ldots \text{diag}\{A_N\}], \quad (17)$$

$$\text{odhv}\{A_1, \ldots, A_N\} \triangleq [\text{odhv}\{A_1\} \ldots \text{odhv}\{A_N\}], \quad (18)$$

By using these notations, Equation (14) is reorganized to get $$\hat{\phi}_{xx}(k)=\Theta\cdot\chi(k), \quad (19)$$

where parameter jω is omitted for clarity, and $$\hat{\phi}_{xx}(k) \triangleq \begin{bmatrix} \text{diag}\{\hat{R}_{xx}(j\omega, k)\} \\ odhv\{\hat{R}_{xx}(j\omega, k)\} \end{bmatrix}, \Theta \triangleq \begin{bmatrix} D(j\omega) \\ C(j\omega) \end{bmatrix},$$

$$D(j\omega) \triangleq \text{diag}\{P_{g_s}(j\omega), P_{g_v}(j\omega), \Gamma_{uu}(j\omega), I_{M\times M}\},$$

$$C(j\omega) \triangleq odhv\{P_{g_s}(j\omega), P_{g_v}(j\omega), \Gamma_{uu}(j\omega), I_{M\times M}\},$$

$$\chi(k) \triangleq [\ \sigma_s^2(\omega, k)\quad \sigma_v^2(\omega, k)\quad \sigma_u^2(\omega, k)\quad \sigma_\omega^2(\omega, k)\ ]^T.$$

Here, the result is M (M+1)/2 equations and 4 unknowns. If M≥3, this is an overdetermined problem. That is, there are more equations than unknowns.

The aforementioned error criterion is written as $$J \triangleq \|\hat{\phi}_{xx}(k)-\Theta\cdot\chi(k)\|^2. \quad (20)$$

Minimizing this criterion, implemented as estimating the power of sound sources (150*a*), leads to $$\hat{\chi}_{LS}(k)=\Re\{(\Theta^H\Theta)^{-1}\Theta^H\hat{\phi}_{xx}(k)\}, \quad (21)$$

where $\Re\{\bullet\}$ denotes the real part of a complex number/vector. Presumably the estimation errors in $\hat{\phi}_{xx}(k)$ are IID (independent and identically distributed) random variables. Thus, as implemented in calculating the post-filter coefficients (155*a*), the LS (least-squares) solution given in Equation (21) is optimal in the MMSE sense. Substituting this estimate into Equation (11) leads to, as referred to in this disclosure, a LS post-filter (LSPF) (160*a*).

In the above described example embodiment, the deduced LS solution assumes that M≥3. This is due to the use of a more generalized acoustic-field model that consists of four types of sound signals. In other example embodiments, where additional information regarding the acoustic field is available, such that some types of interfering signals can be ignored (e.g., no point interferer and/or merely white noise), then those columns in Equation (19) that correspond to these ignorable sound sources can be removed and an LSPF as described in the present disclosure may still be developed even with M=2.

Figure 5:
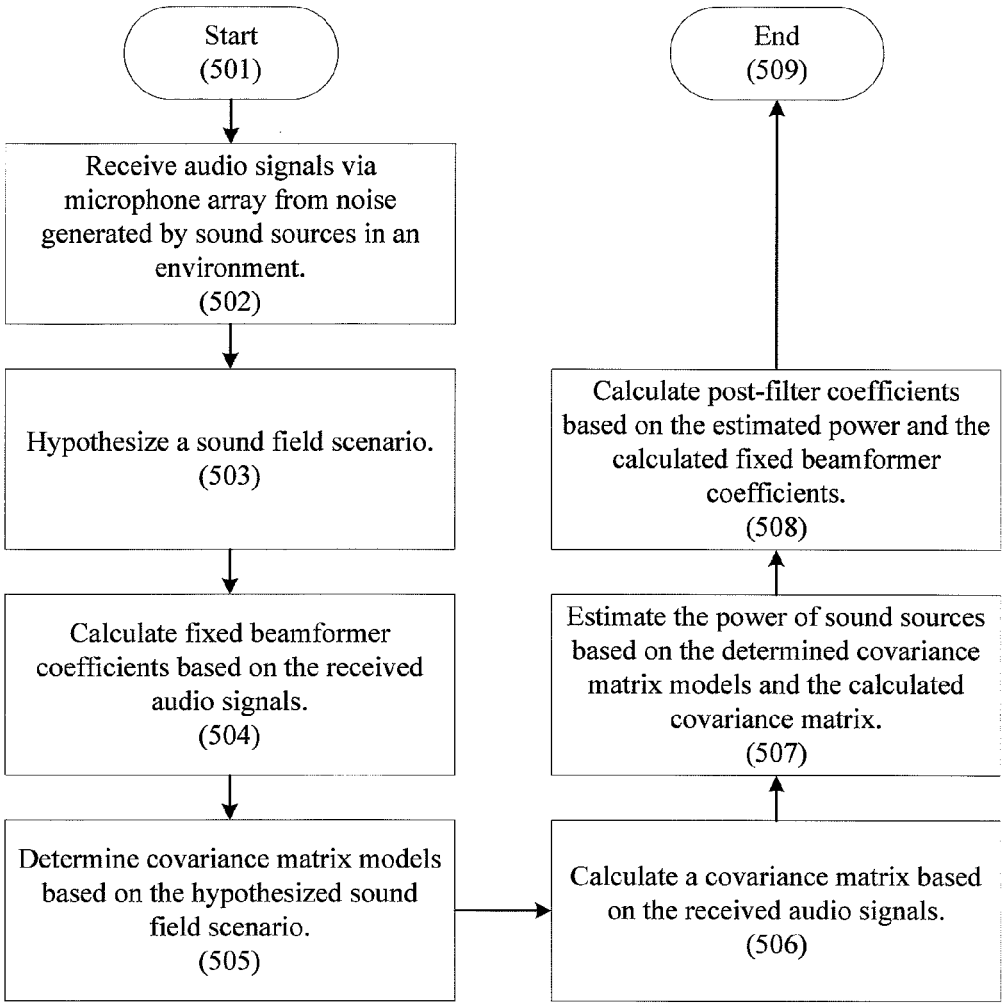
FIG. 5 is a flowchart illustrating example steps for calculating the post-filter coefficients for a frequency bin, in accordance with an embodiment of this disclosure.

FIG. 5 is a flowchart illustrating example steps for calculating the post-filter coefficients for a frequency bin (165*a*), in accordance with an embodiment of this disclosure. The following illustration in FIG. 5 reflects an example implementation of the above disclosed details and mathematical concepts described above. The disclosed steps are given by way of illustration only. As would be apparent to one skilled in the art, some steps may be done in parallel or in an alternate sequence within the spirit and scope of this Detailed Description.

Referring to FIG. 5, the example steps start at step 501. In step 502, audio signals are received via microphone array (130) from noise generated (109) by sound sources (106-108) in an environment (105). In step 503, a sound field scenario (111) is hypothesized. In step 504, fixed beamformer coefficients (138*a*) are calculated based on the received audio signals (117*a*, 122*a*, 127*a*) for a frequency bin (165*a*). In step 505, covariance matrix models (140*a*) based on the hypothesized sound field scenario (111) are determined. In step 506, a covariance matrix (145*a*) based on the received audio signals (117*a*, 122*a*, 127*a*) is calculated. In step 507, the power of the sound sources (150*a*), based on the determined covariance matrix models (140*a*) and the calculated covariance matrix (145*a*), are estimated. In step 508, post-filter coefficients (155*a*), based on the estimated power of the sound sources (150*a*) and the calculated fixed beamformer coefficients (138*a*), are calculated. The example steps may proceed to the end step 509. The aforementioned steps may be implemented per frequency bin (165*a-c*) to generate the post-filtered output signals (161*a-c*) respectively. The post-filtered signals (161*a-c*) may then be transformed (170) to generate the final output/desired signal (175).

As mentioned above, conventional post-filtering methods are not optimal and have deficiencies when compared to methods and systems described herein. The limitations and deficiencies of existing approaches, with respect to the present disclosure, are further described below.

(a) Zelinski's Post-Filter (ZPF) assumes: 1) no point interferer, i.e., $\sigma_v^2(\omega)=0$, 2), no diffuse noise, i.e., $\sigma_u^2(\omega)=0$, and 3) only additive incoherent white noise. Thus, Equation (19) is simplified as follows $$\begin{bmatrix} \mathrm{diag}\{\hat{R}_{xx}(k)\} \\ odhv\{\hat{R}_{xx}(k)\} \end{bmatrix} = \begin{bmatrix} \mathrm{diag}\{P_{g_s}\} & I_{M\times 1} \\ odhv\{P|_{g_s}\} & 0 \end{bmatrix} \begin{bmatrix} \sigma_s^2(k) \\ \sigma_\omega^2(k) \end{bmatrix}. \tag{22}$$

Instead of calculating the optimal LS solution for $\sigma_s^2(k)$ using Equation (21), the ZPF uses only the bottom odhv-part of Equation (22) to get $$\hat{\sigma}_{s,ZPF}^2(k) = \frac{\sum_{p=1}^{M(M-1)/2} \Re\{odhv\{\hat{R}_{xx}(k)\}\}_p}{\sum_{p=1}^{M(M-1)/2} \Re\{odhv\{P_{g_s}\}\}_p}, \tag{23}$$

Note, from Equation (13) that $\Re\{\mathrm{odhv}\{P_{g_s}\}\}_p=1$. Thus, Equation (23) becomes $$\hat{\sigma}_{s,ZPF}^2(k) = \frac{\sum_{p=1}^{M(M-1)/2} \Re\{odhv\{\hat{R}_{xx}(k)\}\}_p}{M(M-1)/2}. \tag{24}$$

If the same acoustic model for the LSPF is used for ZPF (e.g., only white noise), it can be shown that the ZPF and the LSPF are equivalent when M=2. However, they are fundamentally different when M≥3.

(b) McCowan's Post-Filter (MPF) assumes: 1) no point interferer, i.e., $\sigma_v^2(\omega)=0$, 2), no additive white noise, i.e., $\sigma_w^2(\omega)=0$, and 3) only diffuse noise. Under these assumptions, Equation (19) becomes $$\begin{bmatrix} \mathrm{diag}\{\hat{R}_{xx}(k)\} \\ odhv\{\hat{R}_{xx}(k)\} \end{bmatrix} = \begin{bmatrix} \mathrm{diag}\{P_{g_s}\} & \mathrm{diag}\{\Gamma_{uu}\} \\ odhv\{P_{g_s}\} & odhv\{\Gamma_{uu}\} \end{bmatrix} \begin{bmatrix} \sigma_s^2(k) \\ \sigma_u^2(k) \end{bmatrix}. \tag{25}$$

Note from Equation (9) that $\mathrm{diag}\{\Gamma_{uu}\}=1_{M\times 1}$.

Equation (25) is an overdetermined system. Again, instead of finding a global LS solution by following Equation (21), the MPF applies three equations from Equation (25) that correspond to the pair of the pth and qth microphones to form a subsystem like the following $$\begin{bmatrix} \hat{\sigma}_{x_px_p}^2 \\ \hat{\sigma}_{x_qx_q}^2 \\ \hat{\phi}_{x_px_q} \end{bmatrix} = \begin{bmatrix} 1 & 1 \\ 1 & 1 \\ 1 & \Gamma_{pq} \end{bmatrix} \cdot \begin{bmatrix} \sigma_s^2 \\ \sigma_u^2 \end{bmatrix}, \tag{26}$$

where $$\hat{\phi}_{x_px_q} \triangleq \Re\{\hat{R}_{xx}\}_{p,q},\ \Gamma_{pq} \triangleq \Re\{\Gamma_{uu}\}_{p,q}.$$

The MPF method solves Equation (26) for $\sigma_s^2$ as $$\{\hat{\sigma}_{s,MPF}^2\}_{p,q} = \frac{(\hat{\sigma}_{x_px_p}^2 + \hat{\sigma}_{x_qx_q}^2)/2 - \hat{\phi}_{x_px_q}}{1-\Gamma_{pq}}. \tag{27}$$

Since there are M (M−1)/2 different microphone pairs, the final MPF estimate is simply the average of the subsystems' results, as follows:

$$\hat{\sigma}_{s,MPF}^2 = \frac{\sum_{p=1}^{M-1}\sum_{q=p+1}^{M} \{\hat{\sigma}_{s,MPF}^2\}_{p,q}}{M(M-1)/2}. \tag{28}$$

The diffuse noise model is more common in practice than the white noise model. The latter can be regarded as a special case of the former when $\Gamma_{uu}=I_{M\times M}$. But the MPF's approach to solving Equation (25) is heuristic and is also not optimal. Again, if LSPF uses a diffuse-noise-only model, it is equivalent to the MPF when M=2, but they are fundamentally different when M≥3.

(c) Leukimmiatis's Post-Filter follows the algorithm proposed in the MPF to estimate $\sigma_s^2$ (k). Leukimmiatis et al. simply fixes the bug in Zelinski's and McCowan's postfilters that the denominator of the post-filter in (11) should be $\sigma_{s'}^2(\omega)+\sigma_{\psi'}^2(\omega)$ rather than $\sigma_s^2(\omega)+\sigma_\psi^2(\omega)$.

6. Experimental Results

Figure 6:
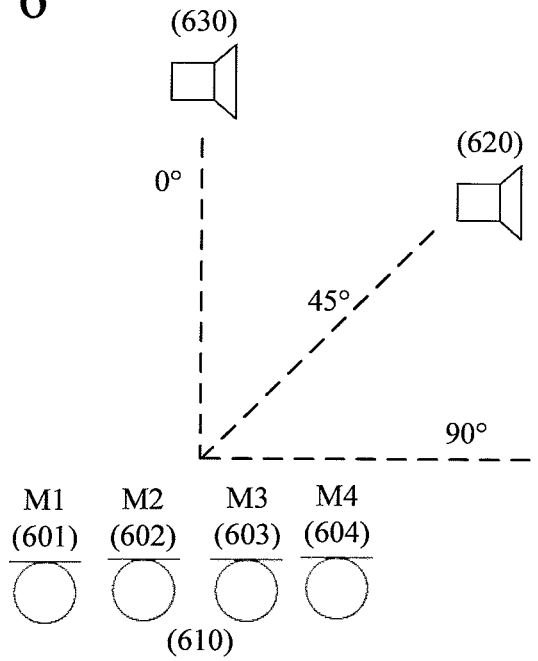
FIG. 6 illustrates the spatial arrangement of the microphone array and the sound sources related to the experimental results.

The following provides results of example speech enhancement experiments performed to validate the LSPF method and systems of the present disclosure. FIG. 6 illustrates the spatial arrangement of the microphone array (610) and the sound sources (620, 630) of the experiments. The positions of the elements within the figures are not intended to convey exact scale or distance, which are provided in the following description. Provided is a set of experiments that considers the first four microphones M1-M4 (601-604) of a microphone array (610), where the spacing between each of the microphones is 3 cm. The 60 dB reverberation time is 360 ms. The desired source (620) is at the broadside (0°) of the array while the interfering source (630) is at the 45° direction. Both are 2 m from the array. Clean, continuous, 16 kHz/16-bit speech signals are used for these point sound sources. The desired source (620) is a female speaker and the interfering source (630) is a male speaker. The voiced parts of the two signals have many overlaps. Accordingly, the impulse responses are resampled at 16 kHz and are truncated to 4096 samples and spherically isotropic diffuse noise is generated. In the experimental simulations, 72×36=2592 point sources distributed on a large sphere are used. The signals are truncated to 20 s.

In the above experiments, three full-band measures are defined to characterize a sound field (subscript SF): namely, the signal-to-interference ratio (SIR), signal-to-noise ratio (SNR), and diffuse-to-white-noise ratio (DWR), as follows $$\mathrm{SIR}_{SF} \triangleq 10\cdot\log_{10}\{\sigma_s^2/\sigma_v^2\}, \tag{29}$$

$$\mathrm{SNR}_{SF} \triangleq 10\cdot\log_{10}\{\sigma_s^2/(\sigma_u^2+\sigma_w^2)\}, \tag{30}$$

$$\mathrm{DWR}_{SF} \triangleq 10\cdot\log_{10}\{\sigma_u^2/\sigma_w^2\}, \tag{31}$$

where $\sigma_z^2 \triangleq E\{z^2(t)\}$ and $z \in \{s,v,u,w\}$.

For performance evaluation, two objective metrics are analyzed: the signal-to-interference-and-noise ratio (SINR) and the perceptual evaluation speech quality (PESQ). The SINR's and PESQ's are computed at each microphone and averaged as the input SINR and PESQ, respectively. The output SINR and PESQ (denoted by SINRo and PESQo, respectively) are similarly estimated. The difference between the input and output measures (i.e., the delta values) are analyzed. To better assess the amount of noise reduction and speech distortion at the output, the interference and noise reduction (INR) and the desired-speech only PESQ (dPESQ) are also calculated. For dPESQ's, the processed desired speech and clean speech are passed to the PESQ estimator. The output PESQ indicates the quality of the enhanced signal while the dPESQ value quantifies the amount of speech distortion introduced. The Hu & Loizou's Matlab codes for PESQ are used in this study.

To avoid the well-known signal cancellation problem in the MVDR (minimum variance distortionless response) beamformer due to room reverberation, the delay-and-sum (D&S) beamformer is implemented for front-end processing and compared to the following four different post-filtering algorithms: none, ZPF, MPF, and LSPF. The D&S-only implementation is used as a benchmark. For ZPF and MPF, Leukimmiatis's correction has been employed. Tests were conducted under the following three different setups: 1) White Noise ONLY: SIRSF=30 dB, SNRSF=5 dB, DWRSF32-30 dB, 2) Diffuse Noise ONLY: SIRSF=30 dB, SNRSF=10 dB, DWRSF=30 dB, 3) Mixed Noise/Interferer: SIRSF=0 dB, SNRSF=10 dB, DWRSF=0 dB. The results are as follows:

TABLE 1

Microphone array speech enhancement results.

| Method | INR (dB) | $\mathrm{SINR}_o$/ ΔSINR (dB) | $\mathrm{PESQ}_o$/ ΔPESQ | $\mathrm{dPESQ}_o$/ ΔdPESQ |
|---|---|---|---|---|
| | White Noise Only | | | |
| D&S Only | 5.978 | 14.201/+5.667 | 1.795/+0.363 | 2.286/−0.019 |
| D&S + ZPF | 11.893 | 17.827/+9.293 | 2.055/+0.623 | 2.351/+0.046 |
| D&S + MPF | 16.924 | 17.161/+8.627 | 2.115/+0.683 | 2.130/−0.175 |
| D&S + LSPF | 13.858 | 21.460/+12.925 | 2.180/+0.748 | 2.299/−0.006 |
| | Diffuse Noise Only | | | |
| D&S Only | 3.735 | 16.915/+3.423 | 1.857/+0.088 | 2.286/−0.019 |
| D&S + ZPF | 7.467 | 18.594/+5.102 | 1.954/+0.190 | 2.311/+0.006 |
| D&S + MPF | 10.012 | 16.545/+3.053 | 2.122/+0.358 | 2.427/+0.121 |
| D&S + LSPF | 12.236 | 17.699/+4.207 | 2.254/+0.490 | 2.516/+0.211 |
| | Mixed Noise/Interferer | | | |
| D&S Only | 0.782 | 2.398/+0.435 | 1.493/+0.122 | 2.286/−0.019 |
| D&S + ZPF | 2.879 | 2.424/+0.461 | 1.563/+0.193 | 2.314/+0.009 |
| D&S + MPF | 9.470 | 4.211/+2.248 | 1.791/+0.420 | 2.297/−0.008 |
| D&S + LSPF | 16.374 | 9.773/+7.810 | 1.940/+0.569 | 2.336/+0.031 |

In these tests, the square-root Hamming window and 512-point FFT are used for the STFT analysis. Two neighboring windows have 50% overlapped samples. The weighted overlap-add method is used to reconstruct the processed signal.

The experimental results are summarized in Table 1. First, the results for the white-noise-only sound field are analyzed. Since this is the type of sound field addressed by the ZPF method, the ZPF does a reasonably good job in suppressing noise and enhancing speech quality. However, the proposed LSPF achieves more noise reduction and offers higher output PESQ, albeit it introduces more speech distortion with a slightly lower dPESQ. The MPF produces a deceptively high INR since its SINR gain is lower than that of the ZPF and LSPF. This means that the MPF significantly suppresses not only noise but also speech signals. Its PESQ and dPESQ are lower than that of the LSPF.

In the second sound field, as expected, the D&S beamformer is less effective to deal with diffuse noise and the ZPF's performance degrades too. In this case the MPF's performance is reasonably good while still the LSPF yields evidently best results.

The third sound field is apparently the most challenging case to tackle due to the presence of a time-varying interfering speech source. However, the LSPF outperforms the other conventional methods in all metrics.

Finally, it is noteworthy that these purely objective performance evaluation results are consistent with subjective perception of the four techniques in informal listening tests carried out with a small number of our colleagues.

The present disclosure describes methods and systems for a LS post-filtering method for microphone array applications. Unlike conventional post-filtering techniques, the method described considers not only diffuse and white noise but also point interferers. Moreover it is a globally optimal solution that exploits the information collected by a microphone array more efficiently than conventional methods. Furthermore, the advantages of the disclosed technique over existing methods has been validated and quantified by simulations in various acoustic scenarios.

Figure 7:
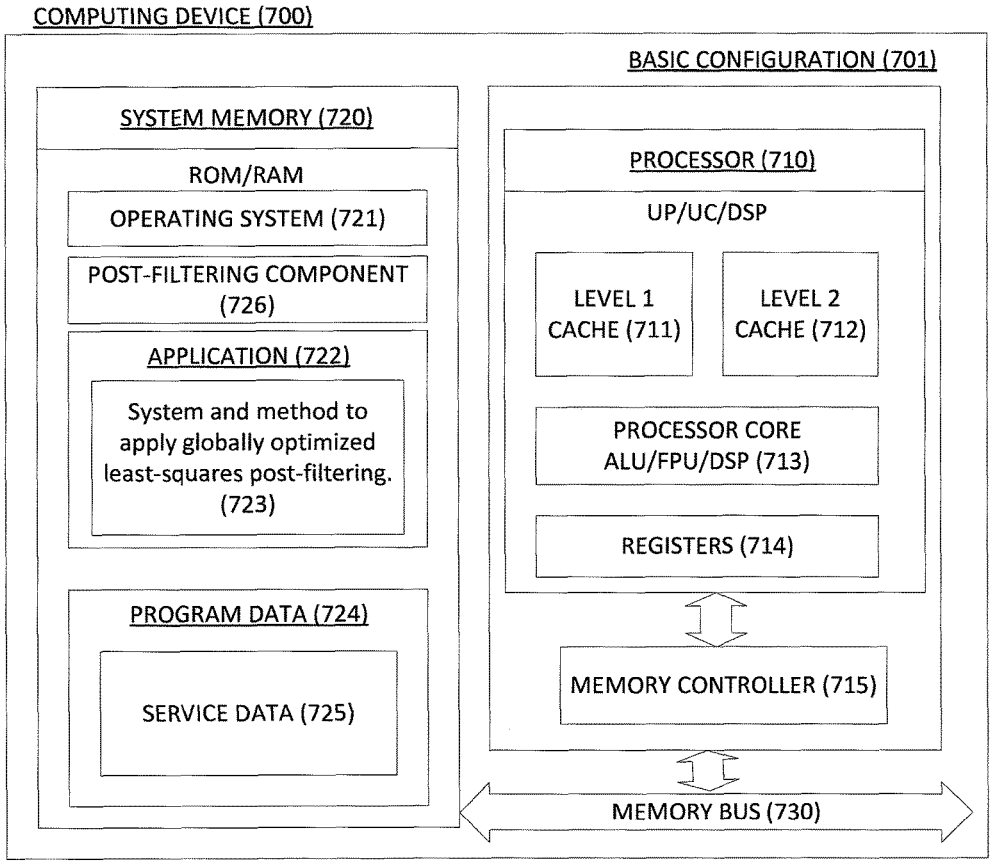
FIG. 7 is a block diagram illustrating an exemplary computing device.

FIG. 7 is a high-level block diagram to show an application on a computing device (700). In a basic configuration (701), the computing device (700) typically includes one or more processors (710), system memory (720), and a memory bus (730). The memory bus is used to do communication between processors and system memory. The configuration may also include a standalone post-filtering component (726) which implements the method described above, or may be integrated into an application (722, 723).

Depending on different configurations, the processor (710) can be a microprocessor (μP), a microcontroller (μC), a digital signal processor (DSP), or any combination thereof. The processor (710) can include one or more levels of caching, such as a L1 cache (711) and a L2 cache (712), a processor core (713), and registers (714). The processor core (713) can include an arithmetic logic unit (ALU), a floating point unit (FPU), a digital signal processing core (DSP Core), or any combination thereof. A memory controller (715) can either be an independent part or an internal part of the processor (710).

Depending on the desired configuration, the system memory (720) can be of any type including but not limited to volatile memory (such as RAM), non-volatile memory (such as ROM, flash memory, etc.) or any combination thereof. System memory (720) typically includes an operating system (721), one or more applications (722), and program data (724). The application (722) may include a post-filtering component (726) or a system and method to apply globally optimized least-squares post-filtering (723) for speech enhancement. Program Data (724) includes storing instructions that, when executed by the one or more processing devices, implement a system and method for the described method and component. (723). Or instructions and implementation of the method may be executed via post-filtering component (726). In some embodiments, the application (722) can be arranged to operate with program data (724) on an operating system (721).

The computing device (700) can have additional features or functionality, and additional interfaces to facilitate communications between the basic configuration (701) and any required devices and interfaces.

System memory (720) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media can be part of the device (700).

The computing device (700) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that includes any of the above functions. The computing device (700) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and/or firmware would be well within the skill of one skilled in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium. (e.g., a fiber optic cable, a waveguide, a wired communications link, a wireless communication link, etc.)

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A computer-implemented method, comprising:

receiving audio signals via a microphone array from sound sources in an environment;

hypothesizing multiple sound field scenarios to generate multiple output signals, including hypothesizing a point interferer, diffuse noise, and white noise, based on the received audio signals;

calculating fixed beamformer coefficients based on the received audio signals;

determining covariance matrix models based on the multiple output signals;

calculating a covariance matrix based on the received audio signals;

estimating power of the sound sources to find a solution that minimizes the difference between the determined covariance matrix models and the calculated covariance matrix;

calculating and applying post-filter coefficients based on the estimated power; and generating an output audio signal based on the received audio signals and the post-filter coefficients.

2. The method of claim 1, wherein the multiple generated output signals are compared and the output signal with the highest signal-to-noise ratio among the multiple output generated signals is selected as the final output signal.

3. The method of claim 1, wherein the estimating of the power is based on a Frobenius norm.

4. The method of claim 3, wherein the Frobenius norm is computed using the Hermitian symmetry of the covariance matrices.

5. The method of claim 1, further comprising:

determining the location of at least one of the sound sources using sound-source location methods to hypothesize the sound field scenarios, determine the covariance matrix models, and calculate the covariance matrix.

6. The method of claim 1, wherein the covariance matrix models are generated based on the plurality of hypothesized sound field scenarios.

7. The method of claim 6, wherein a covariance matrix model is selected to maximize an objective function that reduces noise.

8. The method of claim 7, wherein an objective function is the sample variance of the final output audio signal.

9. An apparatus, comprising:

one or more processing devices and one or more storage devices storing instructions that, when executed by the one or more processing devices, cause the one or processing devices to:

receive audio signals via a microphone array from sound sources in an environment;

hypothesize sound field scenarios to generate multiple output signals, including hypothesizing a point interferer, diffuse noise, and white noise, based on the received audio signals;

calculate fixed beamformer coefficients based on the received audio signals;

determine covariance matrix models based on the multiple output signals;

calculate a covariance matrix based on the received audio signals;

estimate power of the sound sources to find a solution that minimizes the difference between the determined covariance matrix models and the calculated covariance matrix;

calculate and applying post-filter coefficients based on the estimated power; and generate an output audio signal based on the received audio signals and the post-filter coefficients.

10. An apparatus of claim 9, wherein the multiple generated output signals are compared and the output signal with the highest signal-to-noise ratio among the multiple output generated signals.

11. An apparatus of claim 9, wherein the estimating of the power is based on a Frobenius norm.

12. An apparatus of claim 11, wherein the Frobenius norm is computed using a Hermitian symmetry of the covariance matrices.

13. An apparatus of claim 9, further comprising:

determining the location of at least one of the sound sources using sound-source location methods to hypothesize the sound field scenarios, determine the covariance matrix models, and calculate the covariance matrix.

14. A non-transitory computer-readable medium, comprising sets of instructions for:

receiving audio signals via a microphone array from sound sources in an environment;

hypothesizing sound field scenarios to generate multiple output signals, including hypothesizing a point interferer, diffuse noise, and white noise, based on the received audio signals;

calculating fixed beamformer coefficients based on the received audio signals;

determining covariance matrix models based on the multiple output signals;

calculating a covariance matrix based on the received audio signals;

estimating power of the sound sources to find a solution that minimizes the difference between the determined covariance matrix models and the calculated covariance matrix;

calculating and applying post-filter coefficients based on the estimated power; and generating an output audio signal based on the received audio signals and the post-filter coefficients.

15. A non-transitory computer-readable medium of claim 14, wherein the multiple generated output signals are compared and the output signal with the highest signal-to-noise ratio among the multiple output generated signals.

16. A non-transitory computer-readable medium of claim 14, wherein the estimating of the power is based on a Frobenius norm.

17. A non-transitory computer-readable medium of claim 16, wherein the Frobenius norm is computed using a Hermitian symmetry of the covariance matrices.

* * * * *